US007673433B2

(12) United States Patent
Rutman et al.

(10) Patent No.: US 7,673,433 B2
(45) Date of Patent: Mar. 9, 2010

(54) DAMAGE-TOLERANT MONOLITHIC STRUCTURES

(75) Inventors: Alexander Rutman, Wilmington, DE (US); Gary G. Cassatt, Derby, KS (US)

(73) Assignee: The Boeing Company, Chicago, IL (US)

( * ) Notice: Subject to any disclaimer, the term of this patent is extended or adjusted under 35 U.S.C. 154(b) by 558 days.

(21) Appl. No.: 11/117,527

(22) Filed: Apr. 29, 2005

(65) Prior Publication Data

US 2009/0229219 A1 Sep. 17, 2009

(51) Int. Cl.
*E04C 3/00* (2006.01)

(52) U.S. Cl. ..... 52/843; 52/831; 52/850

(58) Field of Classification Search ..... 52/721.2, 52/729.1, 730.6, 730.5, 731.1, 731.2, 731.6, 52/732.1, 735.1, 739.1
See application file for complete search history.

(56) References Cited

U.S. PATENT DOCUMENTS 5,379,567 A * 1/1995 Vahey ..... 52/724.5
5,511,355 A * 4/1996 Dingler ..... 52/729.5
5,848,512 A * 12/1998 Conn ..... 52/729.1
6,247,287 B1 * 6/2001 Takabatake ..... 52/731.6
6,341,467 B1 * 1/2002 Wycech ..... 52/721.4
6,460,309 B1 * 10/2002 Schneider ..... 52/729.1
6,475,577 B1 * 11/2002 Hopton et al. ..... 428/34.7
6,712,315 B2 3/2004 Schmidt et al.
6,807,789 B1 * 10/2004 Kim et al. ..... 52/729.1
7,080,805 B2 7/2006 Prichard et al.
7,503,368 B2 * 3/2009 Chapman et al. ..... 156/425
7,527,222 B2 * 5/2009 Biornstad et al. ..... 244/120
2004/0075027 A1 * 4/2004 Friddell et al. ..... 244/135 R

* cited by examiner

*Primary Examiner*—Richard E Chilcot, Jr.
*Assistant Examiner*—Mark R Wendell

(57) ABSTRACT

A variety of a damage-tolerant monolithic structures are disclosed, such structures having a substantially-planar element integral with or welded to one or more stiffening elements. Each stiffening element can includes a first stiffening flange having a generally rail-like structure running along the length of the planar element and one or more webbings connected to the planar element and extending away from the planar element to the stiffening flange, wherein each webbing includes a row of integral holes running along the length of the webbing, the holes being in a shape designed to hinder the propagation of a crack in the monolithic structure.

14 Claims, 9 Drawing Sheets

DAMAGE-TOLERANT MONOLITHIC STRUCTURES

FIELD OF THE INVENTION

The present invention is directed to monolithic structures capable of resisting crack propagation and maintaining structural integrity in the presence of large cracks.

BACKGROUND OF THE INVENTION

Structures, such as those found on aircraft and spacecraft, are often subject to stresses that may cause cracking in such structures. Left unchecked, such cracks can grow to critical length and cause loss of structural integrity. For example, a wing of an aircraft, which is subject to flexing up and down throughout every flight the aircraft makes, may develop cracks typically running in the fore-aft direction perpendicular to the tension load direction. Such cracking may affect structural integrity resulting in a weakening of the wing. Federal and military regulations require that such structures be designed to the point of being "fail-safe" for the maximum loads expected in any flight. As a result, aircraft that might be deemed very safe even with some cracked components might nonetheless be precluded from flight until the cracked components are repaired. The processes of finding small cracks and equipping every airport to fix every possible structural component of every aircraft may be difficult and expensive. Accordingly, it is desirable to create structures that are capable of retarding cracking to minimize any loss of structural integrity until proper maintenance can be performed.

SUMMARY OF THE INVENTION

In a first aspect, a damage-tolerant monolithic structure configured to resist cracking includes a substantially-planar element having a length, width and thickness, and one or more first stiffening elements monolithically integrated into the first planar element and running in a parallel direction, wherein each first stiffening element includes, a first stiffening flange having a generally rail-like structure running along the length of the planar element and one or more first webbings connected to the planar element and extending away from the planar element to the stiffening flange, wherein each webbing of the first webbings includes a row of integral holes running along the length of the webbing, the holes being in a shape designed to hinder the progress of a crack in the monolithic structure.

In a second aspect, a damage-tolerant monolithic structure configured to resist cracking includes a substantially-planar element having a length, width and thickness, and one or more means for stiffening and providing crack retardation monolithically integrated into the first planar element.

In a third aspect, a method for manufacturing a damage-tolerant monolithic structure configured to resist cracking includes welding a substantially-planar element to one or more first stiffening elements, wherein each first stiffening element includes a first stiffening flange having a generally rail-like structure running along the length of the planar element; and one or more first webbings connected to the planar element and extending away from the planar element to the stiffening flange, wherein each webbing of the first webbings includes a row of integral holes running along the length of the webbing, the holes being in a shape designed to hinder the progress of a crack in the monolithic structure.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Today there is a trend in the aerospace industry to redesign multi-piece structures into monolithic structures to minimize the number of parts. Unfortunately, not all aircraft or spacecraft parts lend themselves to integration without some drawbacks. In particular, a single crack in a monolithic structure can lead to critical damage as the crack grows across the structure. Although a crack in a panel might grow more slowly when confronted with an integral stiffening member, such as an integrated "I-beam", the stiffening member by itself is generally insufficient to completely retard further cracking. Accordingly, some special accommodations must be made for panels (or other structures) needing both structural support and crack retardation.

Figure 1:
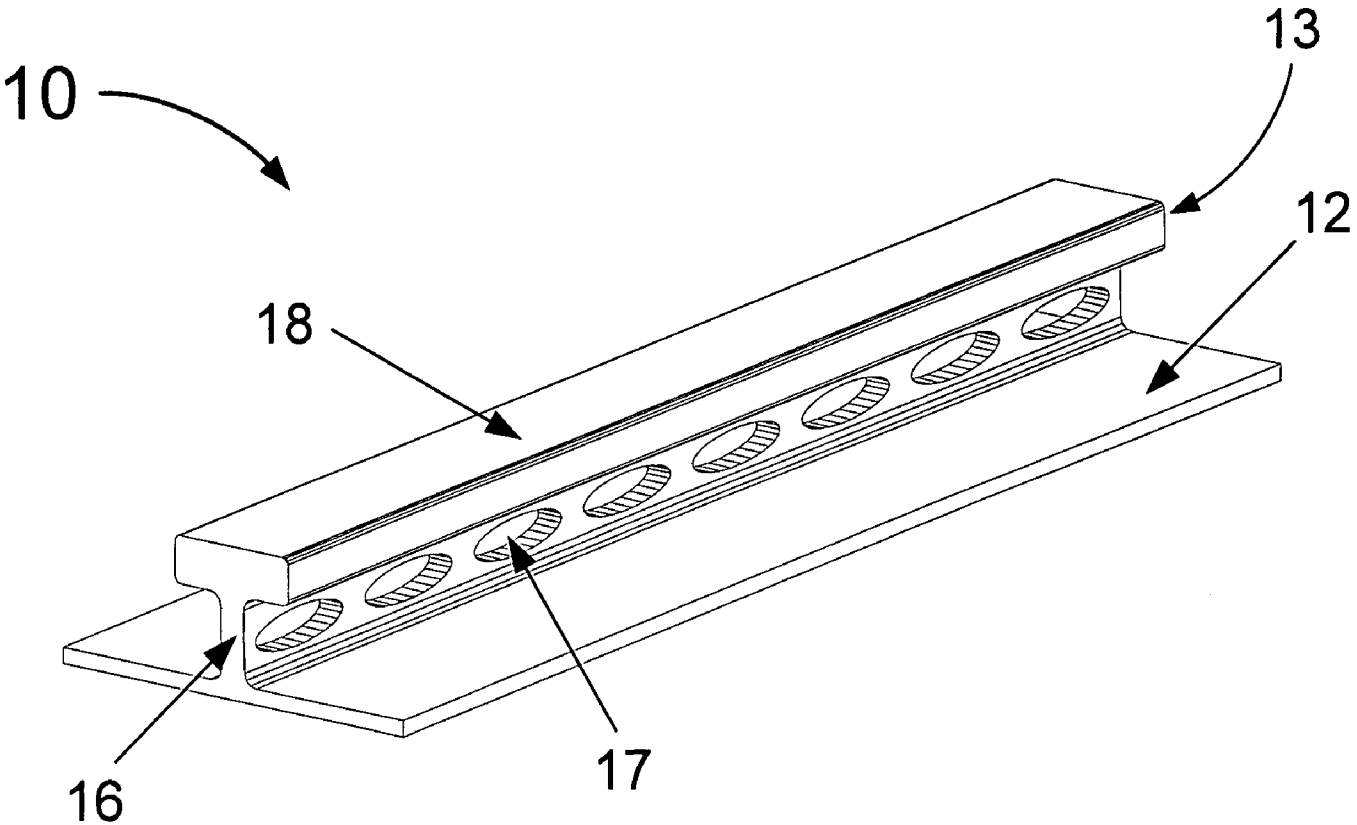
FIG. 1 depicts a planar element with a first single-sided stiffening element capable of hindering cracking.

FIG. 1 depicts a crack-resistant structure 10. As shown in FIG. 1, the crack-resistant structure 10 has a planar element 12 and a stiffening element 13. The stiffening element 13 consists of a flange 18 and a single webbing 16 connecting the flange 18 to the planar element 12. As further shown in FIG. 1, the webbing has a row of elliptical holes 17.

In operation, the modified stiffening element 13 can act both for structural support and as a damage containment device. That is, should a crack form in and propagate across the planar element 12 into the stiffening element 13, the crack will tend to propagate up to the edge of one of the holes 17. Upon reaching a hole 17, the crack will stop propagating. The shape and placement of each hole 17 can be designed to have a low stress concentration to avoid the development of secondary crack initiation. Thus the flange 18 serves to stiffen the planar element 12 while the webbing 16 (with holes 17) serves as a crack-retardation device.

When cracking might otherwise reduce the stiffness of the planar element 12 (or other plate-like structure), the monolithic structure 10 of FIG. 1 can serve to provide structural integrity by redistributing a load between the planar element 12 and the flange 18. Accordingly, it should be appreciated that the particular dimensions of the flange 18 can be specified in a manner to meet various "fail-safe" load conditions despite any substantial cracking that might reasonably be expected to occur. For example, a structural analysis might indicate that under any expected load, the flange 18 would need to be no larger than one inch by two inches even if the planar element 12 had multiple cracks intersecting the stiffening element 14. However, in situations where some "padding" to the specification is desired, such as a 50% overdesign requirement, a 1.5 inch by two inch flange might be appropriate.

Figure 2:
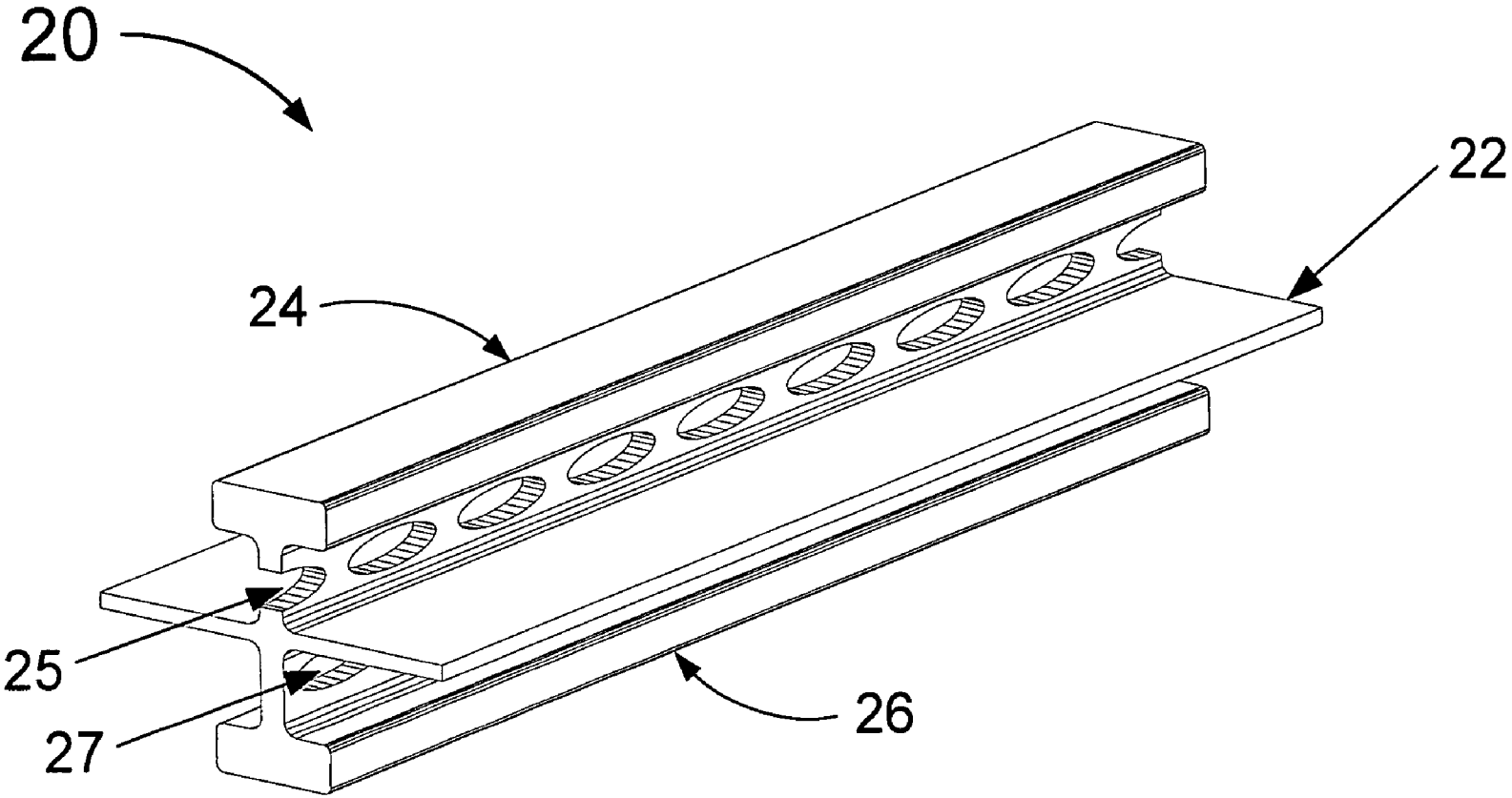
FIG. 2 depicts a planar element with a first two-sided stiffening element capable of hindering cracking.

FIG. 2 depicts a second crack-retardant structure 20 having a planar element 22 and two diametrically opposed stiffening elements 24 and 26. As is evident by FIG. 2, each of the stiffening elements 24 and 26 are individually similar to the one-sided stiffening element 13 of FIG. 1 and similarly integrated into the planar element 22.

As further shown in FIG. 2, the webbing holes 25 for stiffening element 24 are staggered in relation to the webbing holes 27 of stiffening element 26. Such staggering of the holes can provide a more robust crack retardation as compared to configurations where holes might be aligned.

Figure 3:
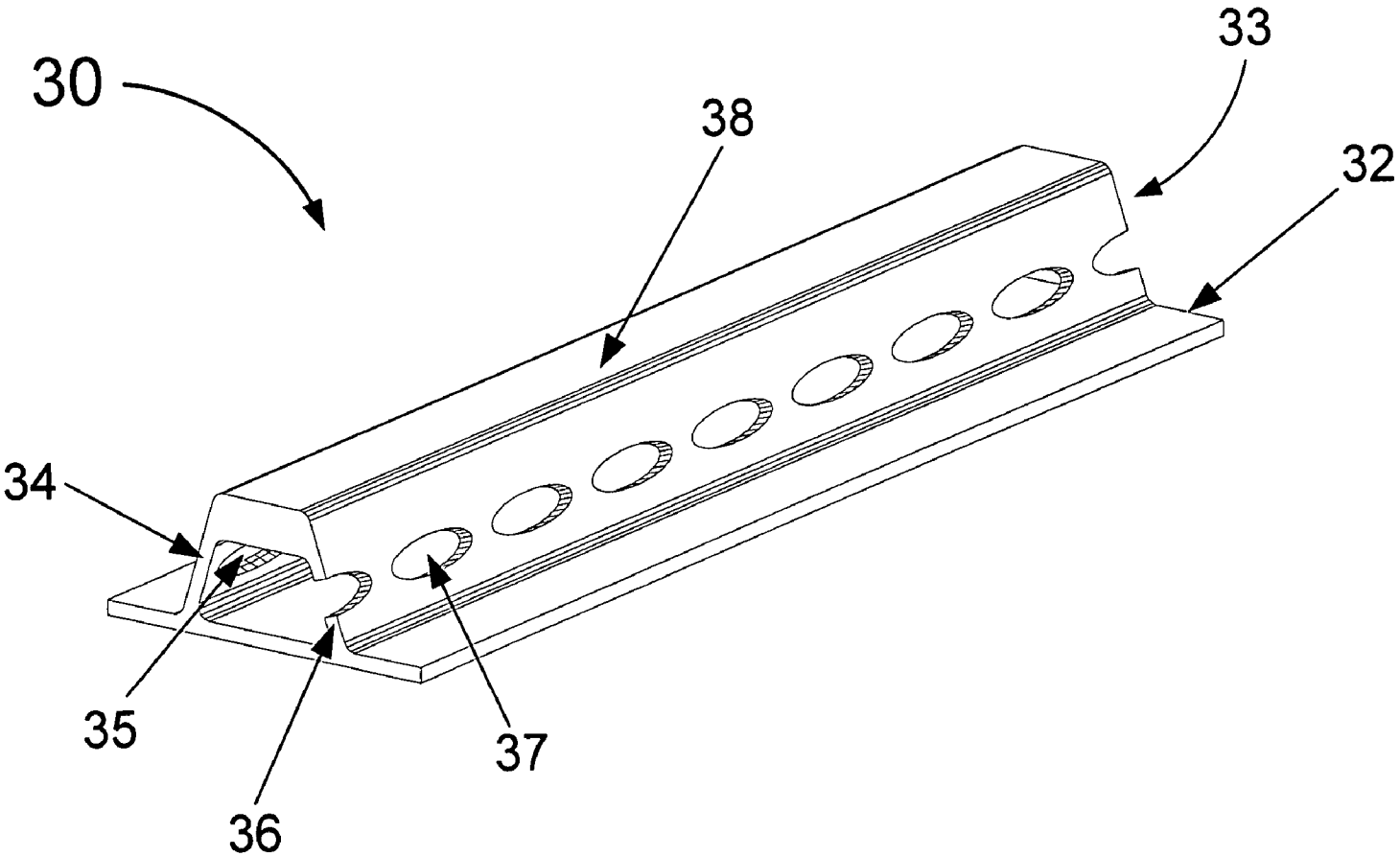
FIG. 3 depicts a planar element with a second single-sided stiffening element capable of hindering cracking.

FIG. 3 shows another structure 30 having crack resistant properties. As shown in FIG. 3, the structure 30 includes a planar element 32 connected to a flange 38 by two webbings 34 and 36 in such a manner as to form an isosceles trapezoidal cross-section with the planar element 32. While the particular configuration reflects an isosceles trapezoidal cross-section, it should be appreciated that other forms of trapezoids or quadrilaterals otherwise might be formed with various degrees of effectiveness.

Also shown in FIG. 3, both webbings 34 and 36 have respective rows of holes 35 and 37, which in the present embodiment are staggered with respect to one another. As with the structure of FIG. 2, staggering the holes 35 and 37 can increase the structure's crack resistive nature.

Figure 4:
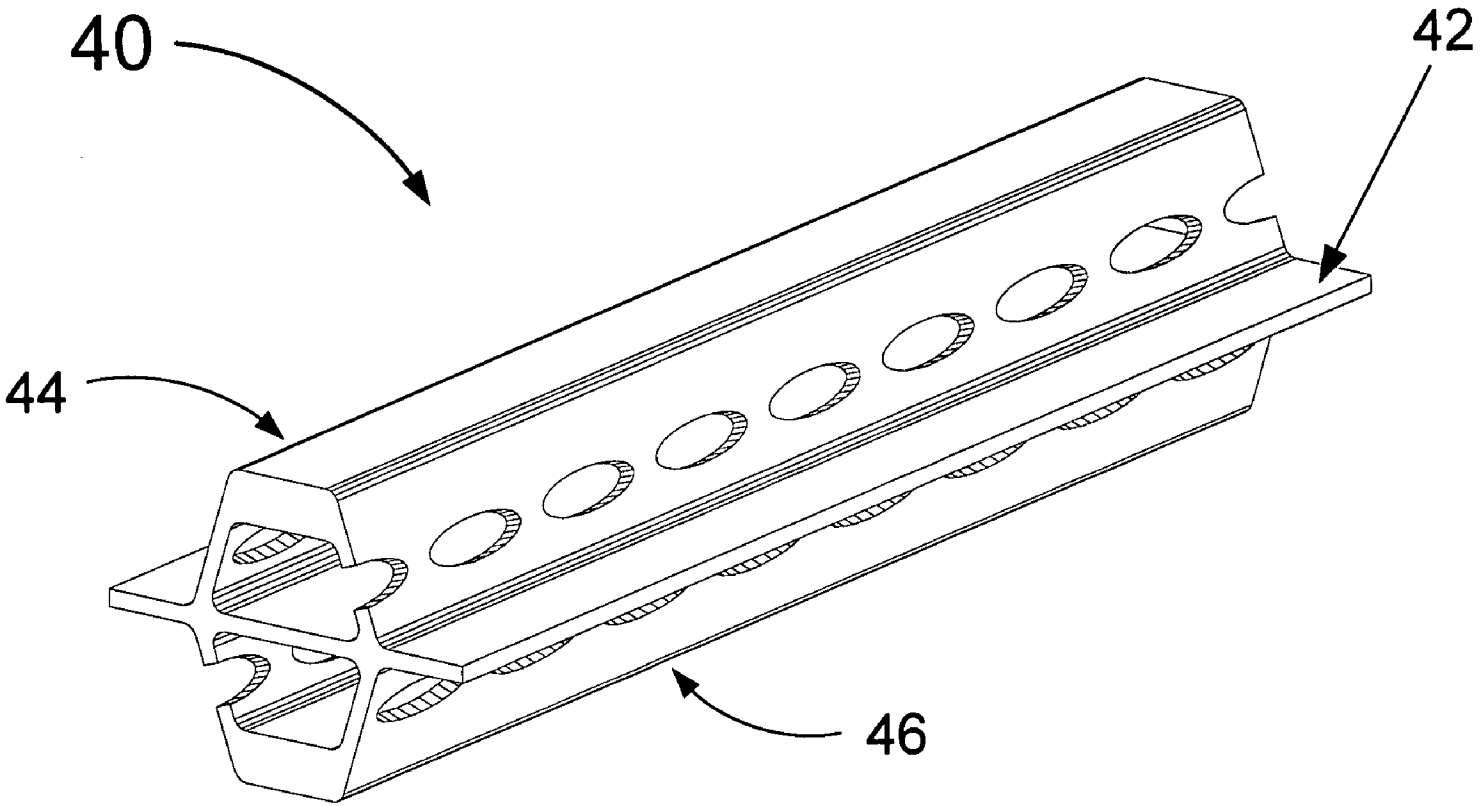
FIG. 4 depicts a planar element with a second two-sided stiffening element capable of hindering cracking.

Next, FIG. 4 depicts yet another structure 40 having planar element 42 and two diametrically opposed stiffening elements 44 and 46. As with the structure of FIG. 2, the double-sided arrangement of crack-resistant stiffening members 44 and 46 can provide increased performance as compared to one-sided stiffening arrangements. A careful view of FIG. 4 shows that the holes for each diametrically opposed webbing are staggered with respect to one another.

Figure 5:
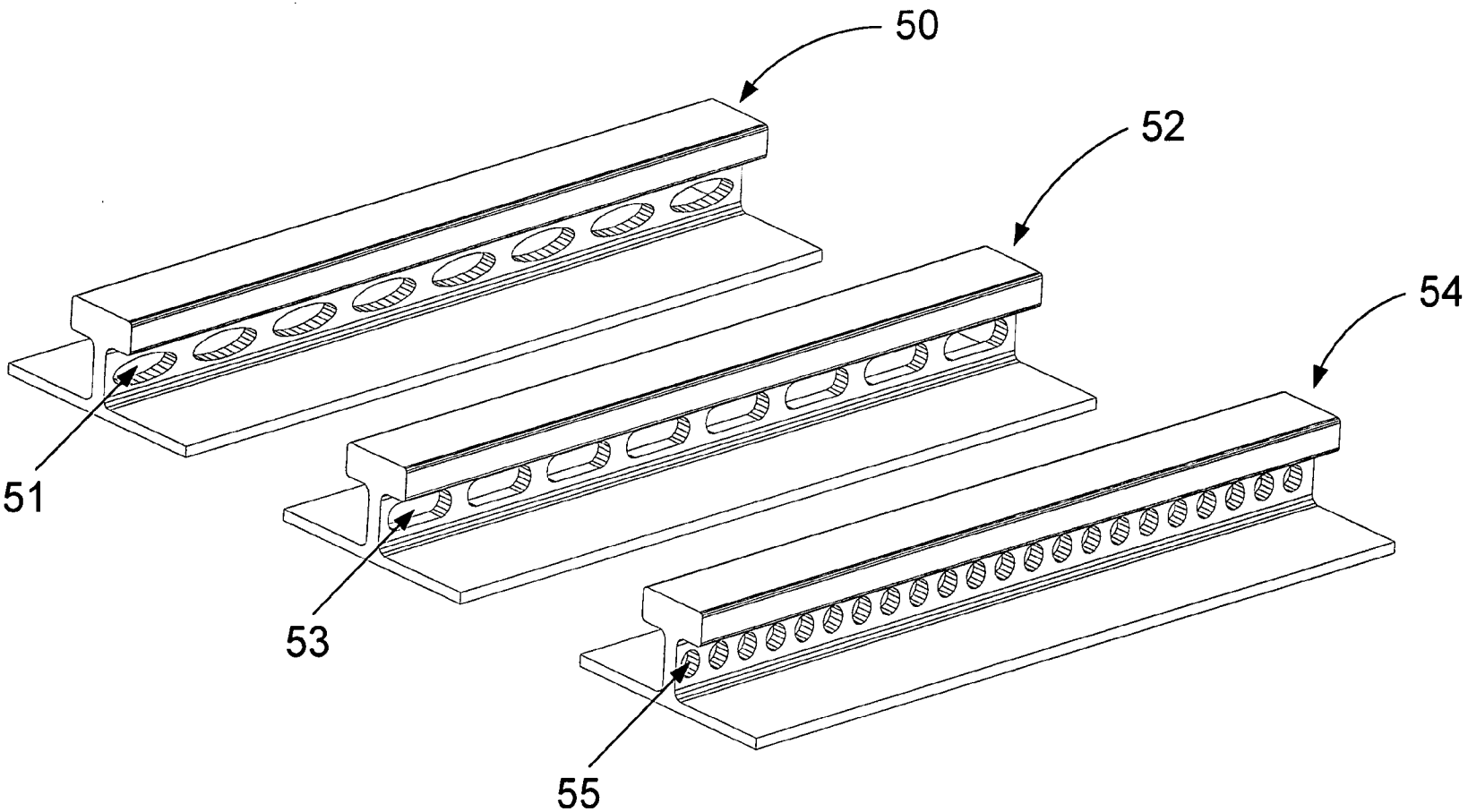
FIG. 5 depicts webbings with a variety of hole types.

FIG. 5 depicts three separate structures 50, 52 and 54 having holes of an elliptical, ovoid and circular nature respectively. Although practically any form of hole might be advantageous, holes having no corners or sharp curves can provide increased performance in comparison to holes having sharp corners or sharply rounded corners.

Figure 6:
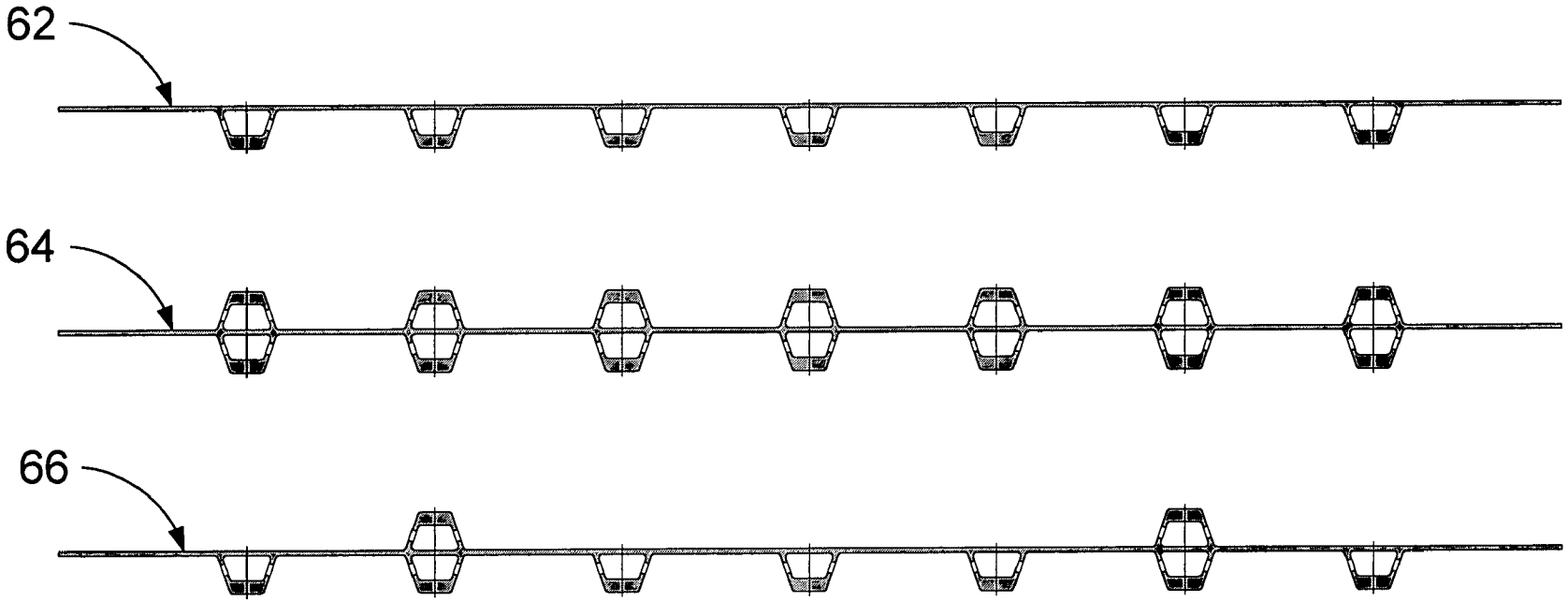
FIG. 6 depicts a variety of planar elements with a stiffening support elements.

FIG. 6 depicts three separate structures 62, 64 and 66 having arrays of one-sided and two-sided stiffening elements. As shown in FIG. 6, structures 62, 64 and 66 can use combinations of the one-sided and two-sided elements shown in FIGS. 3 and 4. However, in other embodiments, combinations of the one-sided and two-sided elements shown in FIGS. 1 and 2 can be used. In still other embodiments, any combination of any of the stiffening structures of FIGS. 1-4 can be used, as well as other stiffening structures not shown. Still further, combinations of the monolithic structures can be made with stiffening components not monolithically integrated.

Still further, in addition to using stiffening elements arranged in simple parallel rows, two-dimensional arrangements of stiffening elements can be applied. For example, in a first embodiment, a combination of any of the stiffening elements depicted in FIGS. 1-4 can be arranged in criss-cross patterns to form inter-dispersed squares, rectangles or diamonds. In still other embodiments, three sets of parallel rows of stiffening elements can be arranged to form inter-dispersed triangles, and so on.

Additionally, instead of using rows of stiffening elements running the length and/or width of a planar element, stiffening elements can be arranged into distinct cells. For example, in a first particular embodiment, stiffening embodiments can be arranged to form multi-sided, e.g., hexagonal or octagonal, cells in a honeycomb-like fashion.

In still other embodiments, stiffening elements can take the form of non-linear members. For example, instead of employing multi-sided cells, an array of stiffening elements having the form of circular rings might be employed. Still further, stiffening elements having complex lines, such as parabolas, can be employed.

While two-dimensional planar elements have been discussed so far, it should be appreciated that the above structural concepts can be applied to three-dimensional structures. For example, the concept of applying the crack-resistant stiffening elements described above can be applied to aircraft wings having simple curves or complex curves. For the purpose of this disclosure, the term "simple curve" can refer to any line that can exist in a single two-dimensional plane, e.g., a ring/circle or parabola. In contrast, a "complex curve" can refer to a line that cannot exist in a single two-dimensional plane, e.g., a spiral/helical curve.

By way of example, the side of a cylinder may be considered a planar element (planar referring to having a relatively small thickness compared to length and width if not strictly existing in a single plane) having a curve about one dimension, i.e., about the central axis in a cylindrical coordinate system. In this instance, a stiffening element can either traverse the length of the cylinder in a straight line (i.e., parallel to the central axis), or alternatively run about the axis of the cylinder in a ring with the flange running roughly parallel to the surface of the cylinder.

In situations where surfaces have a more mild curvature, such as those surfaces that might be found on an aileron, a stiffening element might be similarly made as with the cylinder example above with a flange curving to run roughly parallel to the surface of the aileron. However, in other embodiments, a flange might be made straight with the intermediate webbing changing in height to compensate for the curvature of the aileron surface.

For complex curves, the same concepts described above with regard to simple curves may be similarly applied.

Still further, while it may be desirable to monolithically integrate the stiffening elements and planar elements of FIGS. 1-4, in various other embodiments, other processes of combining stiffening elements and planar elements can be used. For example, metal stiffening elements and planar elements might be attached (but not monolithically integrated) by use of rivets, bonding materials, spot welds, fasteners and so on.

Figure 7:
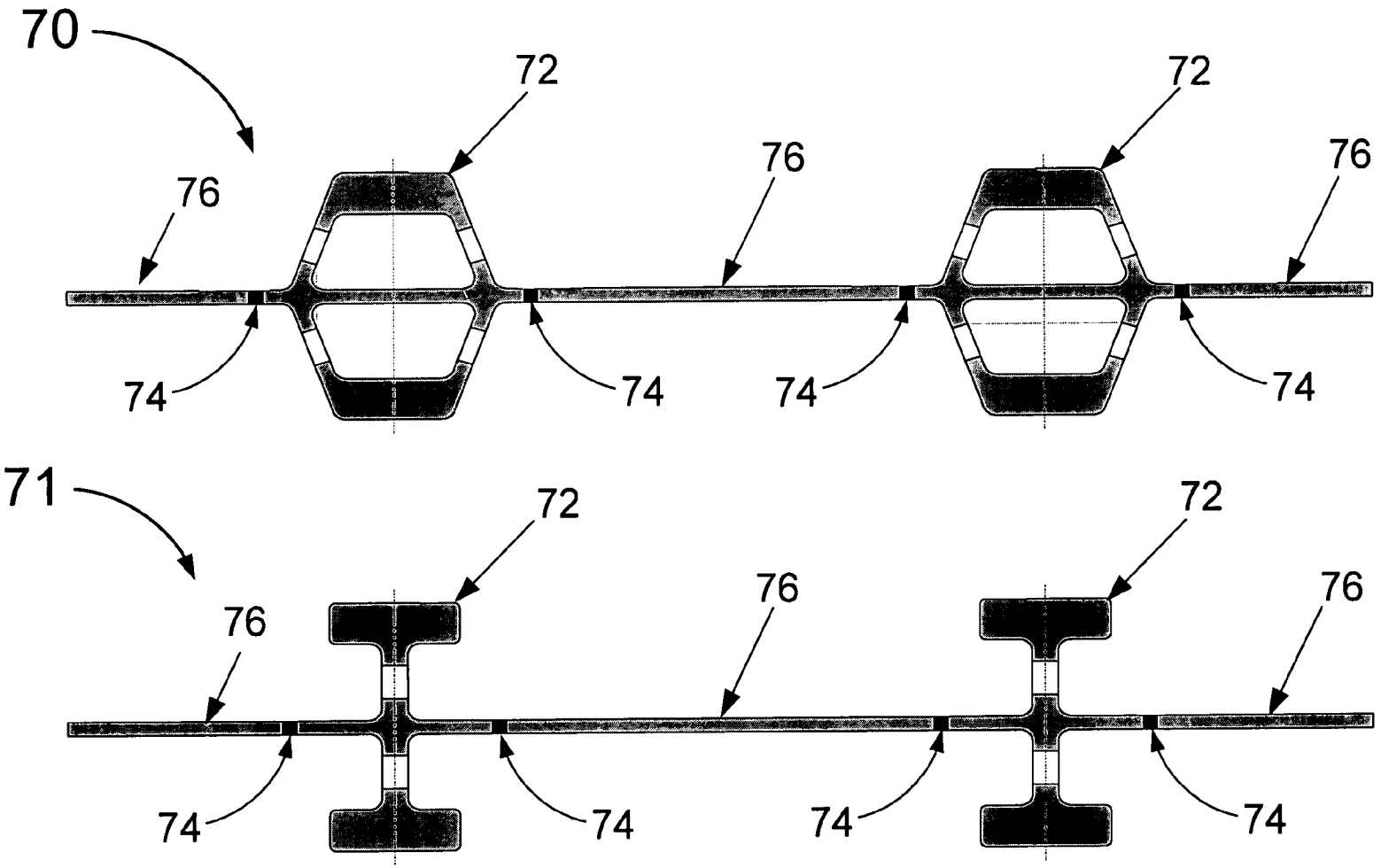
FIG. 7 depicts the manufacture of several crack-tolerant planar elements.
Figure 8:
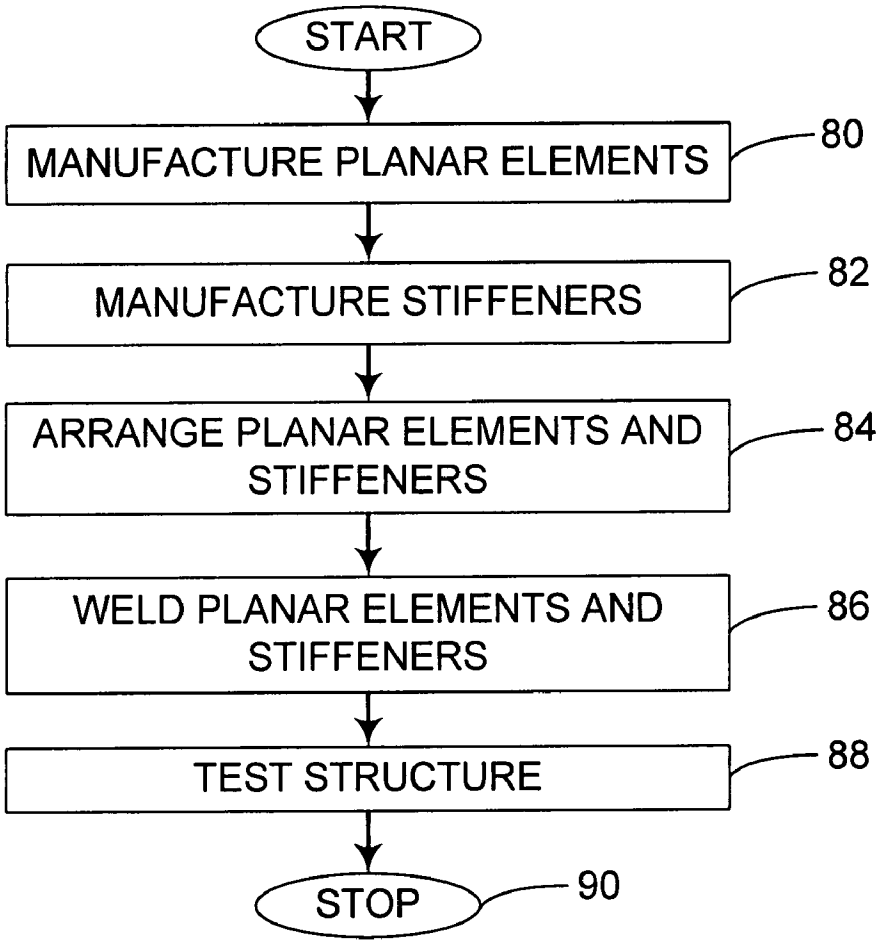
FIG. 8 is a flowchart outlining an exemplary technique for manufacturing damage-tolerant monolithic structures.

FIG. 7 depicts a cross-section view of two monolithic structures 70 and 71 showing planar elements 76 and stiffening elements 72 joined at weld locations 74. FIG. 8 is a flowchart outlining an exemplary technique for manufacturing fail-safe monolithic structures, such as those shown in FIG. 7. The process begins in step 80 where one or more planar elements can be manufactured. While in various embodiments such planar elements can be flat sheets, such as those planar elements 76 shown in FIG. 7, as discussed above such planar elements can take three-dimensional forms, such as portions of cylinders, spheres, etc as well as more esoterically curved forms. Control continues to step 82.

In step 82, stiffening elements designed to complement the planar elements of step 80 can be manufactured. The stiffening elements can be any of those described above with respect to FIGS. 1-4 or structures having similar properties and functionality. Control continues to step 84.

In step 84, the planar elements and stiffening elements of steps 80 and 82 can then be spatially arranged with respect to one another. Returning to FIG. 7 as an example, the planar elements 76 are appropriately arranged with respect to stiffening elements 72 by having their ends aligned at welding locations 74. While FIG. 7 reflects stiffening elements running in a parallel direction, it should be appreciated that arranging planar elements and stiffening elements will change somewhat from embodiment to embodiment depending on whether the stiffening elements are to be arranged in crossing patterns, arranged into honeycomb structures, arranged in three-dimensional curved structures and so on. Control continues to step 86.

In step 86, the planar elements and stiffening elements are welded to one another. In the particular instance where the planar elements and stiffening elements are made of certain metals or plastics/resins, a welding process (e.g., friction-welding or arc-welding) or other usable process might be employed. For circumstances where structures are made of other materials, such as composites (e.g., laminates), certain plastics, ceramics, certain metals, glass etc, welding may take a number or combination of forms including the application of friction or heat, chemical bonding, ultraviolet curing or any other process that may be found useful or advantageous. Next, in step 88 the assembled structure(s) can be tested for overall structural integrity, integrity of the welds and so on. Control then continues to step 90 where the process stops.

Figure 9:
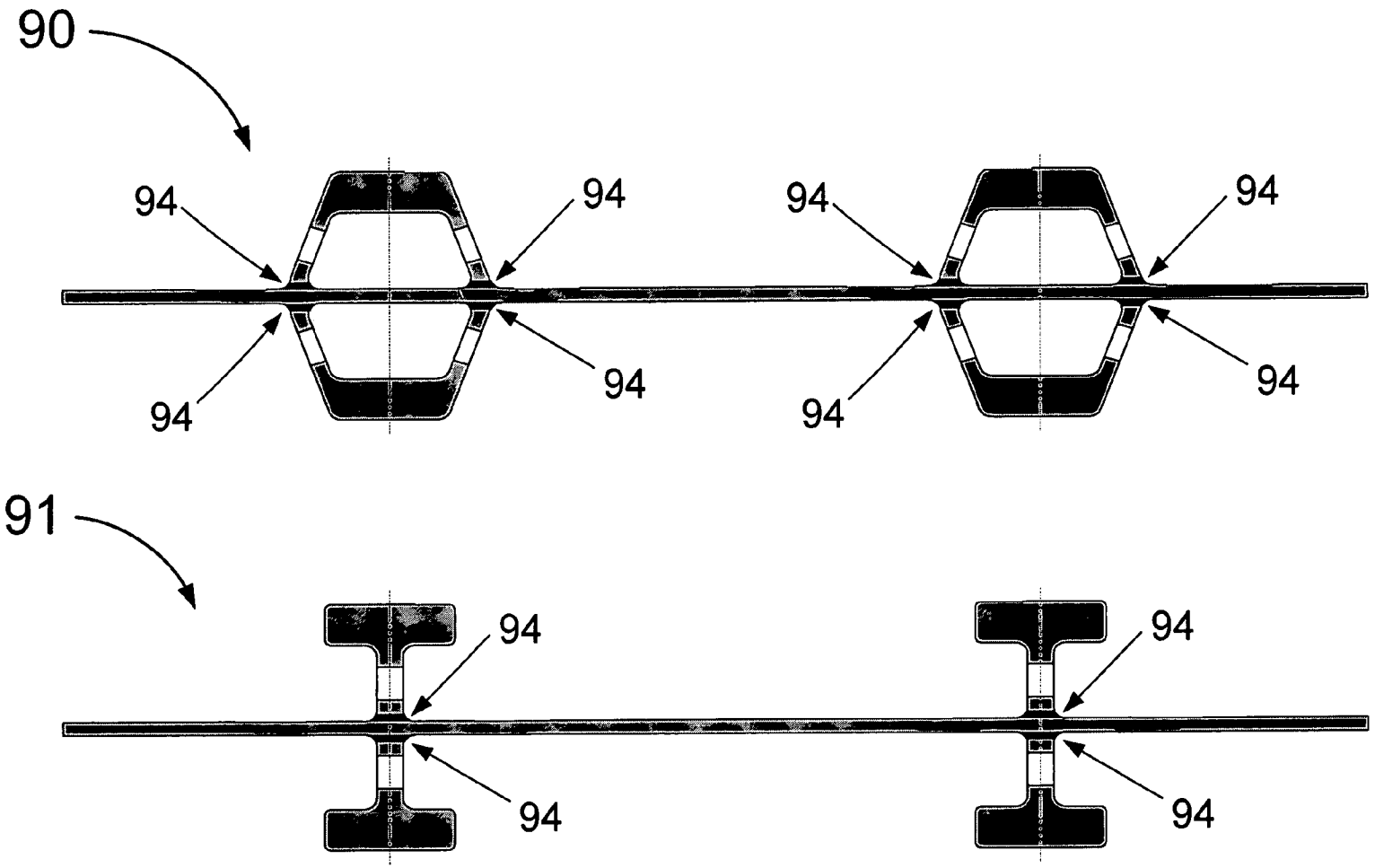
FIG. 9 depicts the manufacture of several crack-tolerant planar elements.

While FIG. 7 depicts welds between planar elements and stiffening elements combined with sections of planar elements, it should be appreciated that the location of weld points can change from embodiment to embodiment. For example, referring to FIG. 9, welding locations 94 are quite different for structures 90 and 91 being situated at the base of each webbing. For manufacturing embodiments envisioned by FIG. 9, "spatially arrangement" of planar elements and stiffening elements takes a different form.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A damage-tolerant monolithic structure configured to resist cracking, the structure comprising:

a substantially-planar element having a length, width and thickness; and one or more first stiffening elements monolithically integrated into the first planar element and running in a parallel direction, wherein each first stiffening element includes, a first stiffening flange having a generally rail-like structure running along the length of the planar element; and a first webbing connected to the planar element and extending away from the planar element to the stiffening flange;

wherein the first webbing includes a first row of integral holes running along the length of the first webbing, wherein the holes are substantially oval in shape to hinder the progress of a crack in the monolithic structure;

a second webbing including a second row of integral holes running along the length of the second webbing, the second row or integral holes having holes staggered relative to the holes in the first row of integral holes; and one or more second stiffening elements monolithically integrated into the planar element on a side of the planar element opposite the first stiffening elements, wherein the second stiffening elements run in a non-parallel direction with respect to the first stiffening elements.

2. The damage-tolerant monolithic structure of claim 1, further comprising a second stiffening flange and wherein the second stiffening flange is connected to the planar element by the second webbing.

3. The damage-tolerant monolithic structure of claim 1, wherein the first stiffening flange is connected to the planar element by the first and second webbing.

4. The damage-tolerant monolithic structure of claim 3, wherein the planar element, the first webbing, the second webbing and the first stiffening flange define a rhombus.

5. The damage-tolerant monolithic structure of claim 1, wherein the one or more second stiffening elements are monolithically integrated into the planar element on the an opposite side of the planar element, diametrically opposed to and running parallel to the first stiffening elements.

6. The damage-tolerant monolithic structure of claim 5, wherein each of the one or more second stiffening elements includes:

a second stiffening flange having a generally rail-like structure running along the length of the planar element; and one or more second webbings connected to the planar element and extending away from the planar element to the second stiffening flange;

wherein each webbing of the first webbings includes a row of integral holes running along the length of the webbing, the holes being in a shape designed to hinder the progress of a crack in the monolithic structure.

7. The damage-tolerant monolithic structure of claim 1, wherein the second stiffening elements are substantially orthogonal with respect to the first stiffening elements.

8. The damage-tolerant monolithic structure of claim 1, wherein the planar elements is curved at least along a first axis, and the flange of each stiffening element follows the curvature of the planar element.

9. The damage-tolerant monolithic structure of claim 1, wherein the planar element is curved at least along a first axis, and the flange of each stiffening element follows the curvature of the planar element.

10. The damage-tolerant monolithic structure of claim 1, wherein the monolithic structure is composed primarily of a metal.

11. The damage-tolerant monolithic structure of claim 1, wherein the holes are elliptical in shape.

12. The damage-tolerant monolithic structure of claim 1, wherein the holes are substantially circular in shape.

13. A damage-tolerant monolithic structure configured to resist cracking, the structure comprising:

a substantially-planar element having a length, width and thickness; and a first means for stiffening and providing crack retardation monolithically integrated into the planar element, the first means for stiffening comprising:

a flange means disposed along the length of the planar element;

a first webbing means disposed between the planar element and the flange means, wherein the first webbing means includes a first row of integral holes running along the length of the first webbing means, the holes being substantially elliptical in shape;

a second webbing means including a second row of integral holes running along the length of the second webbing means, the second row or integral holes having holes staggered relative to the holes in the first row of integral holes; and a second means for stiffening and providing crack retardation monolithically integrated into the planar element on a side opposite the first means for stiffening, wherein the second means for stiffening runs in a non-parallel direction with respect to the first means for stiffening.

14. The damage-tolerant monolithic structure of claim 13, wherein at least one of the first and second means for stiffening and providing crack retardation comprises a two-dimensional matrix of elements forming a plurality of cells.

* * * * *